US007064478B2

(12) United States Patent
Azzi et al.

(10) Patent No.: US 7,064,478 B2
(45) Date of Patent: Jun. 20, 2006

(54) COLOR CATHODE-RAY TUBE HAVING INTERNAL MAGNETIC SCREENING

(75) Inventors: Nacerdine Azzi, Fontaine-les-Dijon (FR); Céline Cossu, Saint Apollinaire (FR); Mohamed Massaoudi, Dijon (FR); Sébastien Volatier, Dijon (FR)

(73) Assignee: Thomson Licensing, Boulogne-Billancourt (FR)

( * ) Notice: Subject to any disclaimer, the term of this patent is extended or adjusted under 35 U.S.C. 154(b) by 80 days.

(21) Appl. No.: 10/475,365

(22) PCT Filed: Apr. 8, 2002

(86) PCT No.: PCT/EP02/03879

§ 371 (c)(1),
(2), (4) Date: Oct. 21, 2003

(87) PCT Pub. No.: WO02/089171

PCT Pub. Date: Nov. 7, 2002

(65) Prior Publication Data

US 2004/0130270 A1 Jul. 8, 2004

(30) Foreign Application Priority Data

Apr. 27, 2001 (FR) ..... 01 05761

(51) Int. Cl.
*H01J 29/06* (2006.01)
*H01J 29/02* (2006.01)
*H01F 3/12* (2006.01)

(52) U.S. Cl. ..... 313/440; 313/402; 313/422; 313/442; 335/212; 335/213

(58) Field of Classification Search ..... 313/402, 313/407, 408, 440, 421–422, 442; 335/212, 335/213; 315/5.35, 368.27
See application file for complete search history.

(56) References Cited

U.S. PATENT DOCUMENTS 4,217,566 A * 8/1980 Hamano et al. ..... 335/212

(Continued)

FOREIGN PATENT DOCUMENTS

EP 090643 10/1983

(Continued)

OTHER PUBLICATIONS

Patent Abstracts of Japan, vol. 2, Mar. 31, 1995 & JP 6-310047.

*Primary Examiner*—Karabi Guharay
(74) *Attorney, Agent, or Firm*—Joseph S. Tripoli; Harvey D. Fried; Richard LaPeruta, Jr.

(57) ABSTRACT

The invention is a color cathode-ray tube having a rectangular front face connected to a funnel shaped rear part, a neck connected to the rear part and having an electron gun therein, the gun is used to generate beams intended to scan the front face under the influence of a deflection device placed on the neck of the tube. The deflection device comprising correction magnets placed on the periphery of the device in locations closest to the front face and a magnetic screen within the tube having an opening for passage of the electron beams, wherein the opening has notches in its periphery. The notches are arranged so as to face at least one pair of correction magnets.

8 Claims, 3 Drawing Sheets

U.S. PATENT DOCUMENTS

| | | | | | |
|---|---|---|---|---|---|
| 4,233,582 | A | * | 11/1980 | Abe et al. | 335/213 |
| 4,714,908 | A | * | 12/1987 | Watabe et al. | 335/212 |
| 5,194,776 | A | | 3/1993 | Chevalier | 313/431 |
| 5,773,924 | A | | 6/1998 | Nakamura | 313/402 |
| 5,880,555 | A | | 3/1999 | Park | 313/402 |

FOREIGN PATENT DOCUMENTS

| | | |
|---|---|---|
| EP | 217473 | 4/1987 |
| EP | 418126 | 3/1991 |
| JP | 6-310047 | 11/1994 |

* cited by examiner

COLOR CATHODE-RAY TUBE HAVING INTERNAL MAGNETIC SCREENING

This application claims the benefit, under 35 U.S.C. § 365 of International Application PCT/EP02/03 879, filed Apr. 8, 2002, which was published in accordance with PCT Article 21(2) on Nov. 7, 2002 in English and which claims the benefit of French patent application No. 0105761, filed Apr. 27, 2001.

FIELD OF THE INVENTION

The subject of the present invention is a color cathode-ray tube having a color display screen and an internal magnetic screen suitable for allowing proper correction of the geometry of the image formed on the display screen of the tube.

BACKGROUND OF THE INVENTION

A color cathode-ray tube is composed of a glass envelope comprising an approximately rectangular front face joined to a funnel-shaped rear part terminating in a cylindrical neck. An electron gun is located in the neck and generates electron beams intended to form a color image on a luminescent screen deposited on the internal surface of the front panel. The electron beams are brought into correspondence with the phosphors on the luminescent screen by means of a perforated metal mask, called a color selection mask. The mask is attached to an approximately rectangular rigid frame with two pairs of opposed sides, one pair of short sides and one pair of long sides. An internal magnetic screen is generally placed in the funnel-shaped part of the envelope and is joined to the rear of the frame. The primary objective of this magnetic screen is to reduce the influence of the components of the Earth's magnetic field on the paths of the electron beams so that the angles of incidence of the beams on the selection mask are not significantly modified by these components; otherwise, the points of impact of the beams on the screen will be shifted and illuminate phosphors of a color other than that desired and cause a defect known as a registration error.

Cathode-ray tubes (CRTs) are all the more sensitive to these problems of registration errors with increasing angle of deflection of the electron beams. With the current trend in CRT industry to reduce the depth of the tube in relation to the size of the screen, the propensity for external magnetic fields to cause registration errors in the screen peripheral areas is greater because the required electron beam deflection angle becomes greater in such tubes.

Additionally, the CRT market is seeing a greater interest in tubes having flat faceplate panel. Likewise product with such a geometry will also show an enhanced propensity for external magnetic fields to cause registration errors in the screen peripheral because the electron beam designated for the peripheral area will have to travel a greater distance to such screen areas than in comparable spherical tubes. To correct geometrical distortions of the screen images, one may find it necessary to utilize magnets which are strategically placed outside the tube.

In short, because the angle of deflection of the electron beams of these trendier tubes is greater than in comparable spherical panel tubes with the normal depth, the path travelled by the electron beams emanating from the gun is comparatively longer. This makes them more sensitive to the influence of the Earth's magnetic field.

Three directions of the Earth's field must be taken into consideration. The axial (north/south) field is manifested parallel to the longitudinal axis of the tube, the lateral (east/west) field along the horizontal axis and the vertical field along the vertical axis.

The vertical field does not pose a major problem for registration as it is virtually constant within broad geographical areas. On the other hand, it is necessary to screen the inside of the tube against the axial and lateral fields since their influence depends on the location of the tube and, on the position in which it lies.

The magnetic screens or internal magnetic shields of the prior art are designed to have a shape matching as closely as possible the internal surface of the funnel-shaped part of the envelope. Further, the apertures, their shapes and their numbers are adapted to compensate and reduce the influences of the Earth's field on electron beam misregister. In its front part, the internal magnetic screen is closed by the color selection mask. In its rear part it has an aperture so as to allow the electron beams to pass through.

It has been found that tubes of reduced depth, that is to say tubes for which the angle of horizontal deflection of the electron beams is greater than 108°, have a very high sensitivity to the Earth's magnetic field and that it is necessary for the magnetic screen to extend towards the rear of the tube as close as possible to the deflection device. However, it is no longer possible in this case to place magnets for correcting the geometry of the image in front of the deflection device because the field lines of the magnets will need to be position in the vicinity of the internal magnetic screen and with such placement the magnetic will not have an influence on the electron beams.

Therefore, there is a need for a color cathode-ray tube having improved magnetic screening capabilities.

SUMMARY OF THE INVENTION

The present invention is a color cathode-ray tube comprising a rectangular front face, a funnel-shaped rear part, a neck in which an electron gun is placed in order to generate beams intended to scan the front face under the influence of a deflection device placed on the neck of the tube, the device comprising correction magnets placed on the side of its peripheral part closest to the front face, the tube furthermore comprising an internal magnetic screen, the rear part of which has an opening for passage of the electron beams. The rear part of the magnetic screen has, on its periphery, notches arranged so as to face at least one pair of correction magnets.

BRIEF DESCRIPTION OF THE DRAWINGS

The invention will be more clearly understood with the aid of the following description and from the following figures.

DETAILED DESCRIPTION OF THE INVENTION

Figure 1:
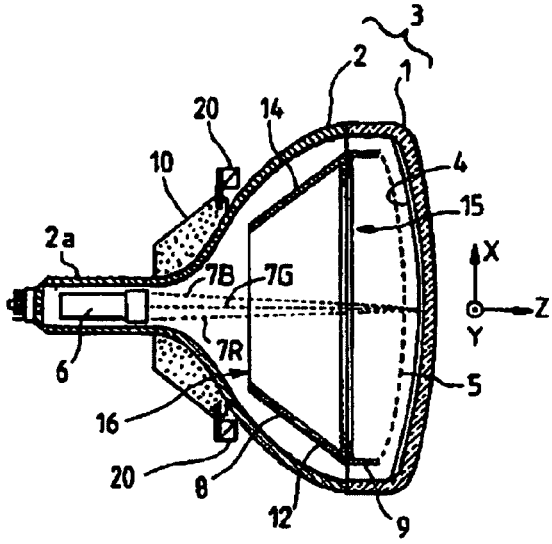
FIG. 1 shows, in section, a cathode-ray tube with its various operating members.

A cathode-ray tube, as illustrated in section in FIG. 1, comprises a glass envelope 3 composed of a front face 1 and a funnel-shaped rear part 2 terminating in a cylindrical neck 2*a*. Deposited on the internal surface of the front face 1 is the screen 4 of luminescent materials, which is intended to reproduce an image under the impact of the electron beams 7B, 7G, 7R emanating from the electron gun 6 fitted into the neck 2*a* of the tube. A shadow mask 5 perforated by holes, allows each electron beam to illuminate only the phosphors of the color corresponding to it. The mask 5 is held inside the tube by means of a metal frame 9. A deflection device 10, generally composed of a pair of horizontal deflection coils and a pair of vertical deflection coils, is placed on the flared rear part of the tube; it furthermore includes, close to its periphery, on the screen side, correction magnets 20. A magnetic screen 14 is placed inside the tube and is fixed to the frame 9 supporting the mask 5.

Figure 2A:
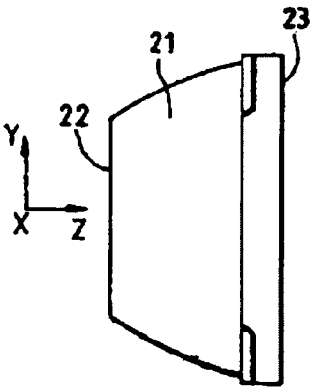
FIGS. 2A and 2B show an example of a side and rear view of a magnetic screen according to the prior art.
Figure 2B:
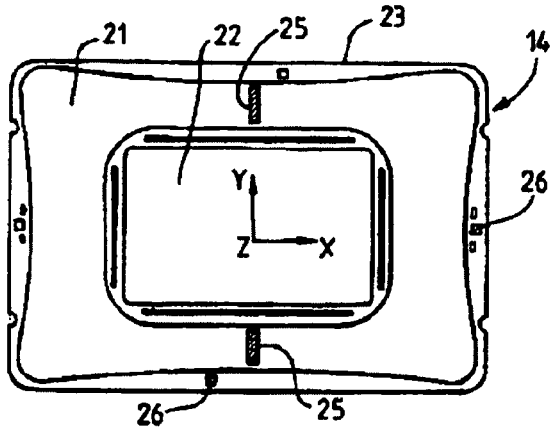
FIG.2B PRIOR ART

FIGS. 2A and 2B illustrate side and rear views of a prior art internal magnetic screen 14. The magnetic screen 14 is produced by stamping a metal sheet so as to give it a shape 21 similar to the shape of the rear part 2 of the tube. The magnetic screen 14 has a front aperture 23 intended to be attached to the frame 9, for example, by clipping it in through apertures 26. The rear aperture 22 is of approximately rectangular shape, the longer sides extending in the horizontal direction X. This configuration is favourable to screening against the axial component of the field but unfavourable to screening against the lateral component of the field; however, the situation is improved by virtue of nicks 25 bringing the screening to a satisfactory level. These nicks 25, of small width, make it possible to increase the relative magnetic resistance in the horizontal direction and tend to favor screening against the lateral component of the Earth's field.

Figure 3A:
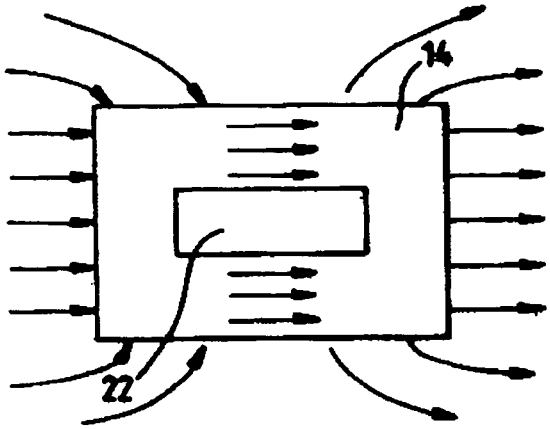
FIG. 3A to 3D illustrate the influence of the Earth's magnetic field on the points of impingement of the electron beams on the screen of the tube for two known types of magnetic screen.
Figure 3B:
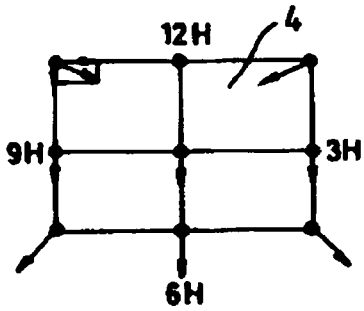

FIGS. 3A to 3D show the influence of the introduction of nicks 25 in the magnetic screen 14 on the forces due to the influence of the Earth's magnetic field which are exerted on the electron beams scanning the screen 4 of the tube. FIG. 3A illustrates an example of a magnetic screen 14 seen from the rear (the Earth's magnetic field lines being represented by arrows) and FIG. 3B illustrates the displacements of the points of impingement of the electron beams on the screen 4 of the tube which are due to the lateral component of the field.

Figure 3C:
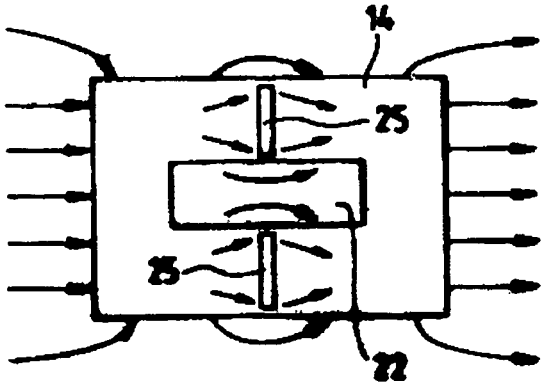
Figure 3D:
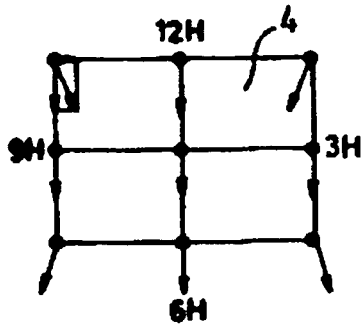

FIG. 3C shows the same magnetic screen 14 provided with nicks 25 at 6o'clock and 12o'clock; these nicks 25 increase the magnetic resistance of the magnetic screen 14 in the horizontal direction, causing the points of impingement of the electron beams to be shifted in the vertical direction, as illustrated in FIG. 3D.

Reducing the depth of cathode-ray tubes requires the angle of deflection of the electron beams to be increased in order to scan the entire screen 4 of the tube. Decreases in the depth are such that the angles of deflection become greater than 108°, and can possibly reach 130°. Such tubes are very sensitive to the Earth's magnetic field and require the presence of a magnetic screen 14 extending towards the rear part 2 to be as close as possible to the deflection device 10. Moreover, when the front face 1 of the tube is also flat, it is necessary to correct the geometry of the image formed on the screen 4 by means of magnets 20 placed in front of the deflection device 10. It will be noted that the force of the magnets 20, necessary to correct the geometry of the image, is very much greater for this type of tube than for tubes having a small angle of deflection (i.e., less than 108°); however, perfect correction cannot be achieved without compromising other parameters of the deflection device. It has been found that this is due to the magnetic coupling between the correction magnets 20 and the magnetic screen 14, which must be as close as possible to the deflection device in order to prevent the Earth's field influencing the electron beams.

Figure 4A:
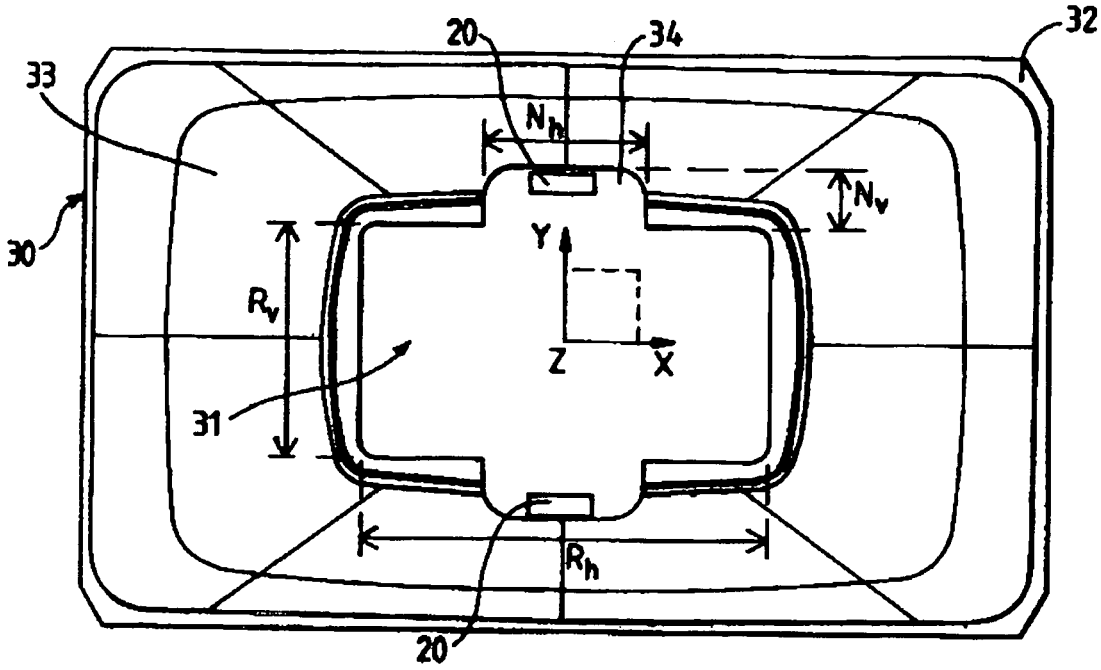
FIGS. 4A and 4B illustrate one embodiment of the invention.
Figure 4B:
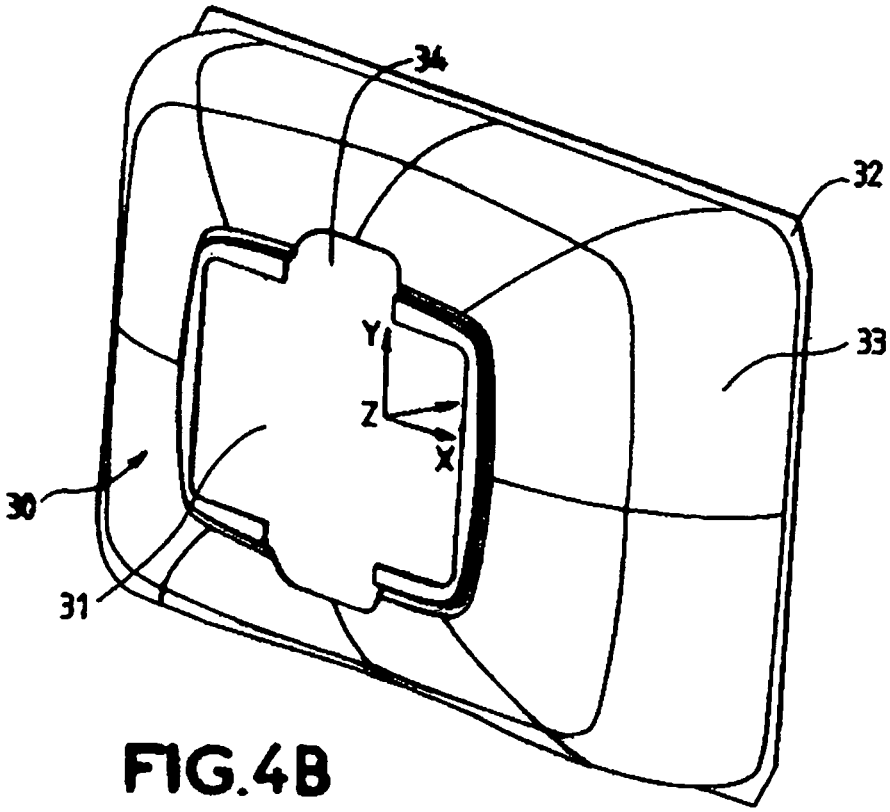

FIGS. 4A and 4B show rear and in perspective views of a magnetic screen 30 according to the invention is equipped. FIG. 4A shows the location of two correction magnets 20 placed along the vertical axis of the tube, on each side of the horizontal plane XZ. The magnetic screen 30 according to the invention comprises, in a known manner, a surface 32 for connecting with the frame 9 supporting the mask 5, a dished surface 33 matching the shape of the internal surface of the flared rear part 2 of the tube, and a rear aperture 31 intended for passage of the electron beams.

The correction magnets 20 in this case are intended to correct the north/south geometry of the image formed on the screen 4 of the tube and are placed on the vertical axis at 6o'clock and 12o'clock. The aperture 31 lies on the main axis Z as close as possible to the deflection device 10 so as to obtain the best possible screening with respect to the Earth's magnetic field.

The aperture 31 has an approximately rectangular shape, with two long sides of length $R_h$, extending in the horizontal direction and two short sides, of length $R_v$, extending in the vertical direction.

Two notches 34 are made on the periphery of the rear aperture 22 of the screen 4 and face the correction magnets 20 when the tube is fitted with its electron-beam deflection device 10. The depth $N_v$ of these notches 34 is sized such that it does not appreciably modify the magnetic resistance of the horizontal parts of the screen 30 and does not reduce the screening against the Earth's field. On the other hand, the width $N_h$ of the notch 34 must be sized to allow the correction magnets 20 to have a positive influence to maintain the geometry of the image, without being so great so as to impair the screening ability of the magnetic screen 30.

It has been found that the best compromise between the screening effect of the magnetic screen 30 and the effect of the magnets 20 on the geometry of the image is obtained by preventing magnetic coupling between the magnets 20 and the screen 30 and, to do this, the depth $N_v$ of the notches 34 must be less than the length $N_h$ of the notch 34, without the length $N_h$ exceeding 60% of the length $R_h$ of that side of the rear aperture 31 in which the notch 34 is located.

Because the notches 34 must face the correction magnets 20, they may advantageously be placed in all directions in which the correction magnets 20 may be placed, that is to say in the 6o'clock–12o'clock vertical direction, in the 3o'clock-9o'clock horizontal direction or along the diagonals of the image.

Likewise, although intended for tubes whose horizontal deflection angle is greater than 108°, the invention may advantageously be used for tubes whose deflection angle is smaller, for example when these tubes are of the high-resolution type and have a high sensitivity to external magnetic fields.

The invention claimed is:

1. Color cathode-ray tube comprising a rectangular flat front face connected to a funnel shaped rear part, a neck connected to the rear part and having an electron gun therein, the gun is used to generate beams intended to scan the front face under the influence of a deflection device placed on the neck of the tube, the device deflects the beams with a deflection angle greater than 108°, wherein correction magnets are placed on the periphery of the device in locations closest to the front face, and a magnetic screen within the tube has an opening for passage of the electron beams, wherein the opening has notches in its periphery, the notches being arranged so as to face at least one pair of correction magnets.

2. Cathode-ray tube according to claim 1, wherein two correction magnets are located on the horizontal axis and the rear aperture of the magnetic screen includes, on its periphery, two notches lying on the horizontal axis, facing the magnets.

3. Cathode-ray tube according to claim 1, wherein two correction magnets are located on the vertical axis and the rear aperture of the magnetic screen includes, on its periphery, two notches lying on the vertical axis, facing the magnets.

4. Cathode-ray tube according to claim 1, wherein the magnets and the notches in the rear aperture of the magnetic screen lie along the directions of the diagonals of the front face of the tube.

5. Cathode-ray tube according to claim 1, wherein at least one correction magnets is located on the horizontal axis and at least one correction magnets is located on the vertical axis; and the rear aperture of the magnetic screen includes, on its periphery, notches respectively lying on the horizontal axis and vertical axis such that the notches are facing the magnets.

6. Cathode-ray tube according to claim 1, wherein the rear aperture of the magnetic screen has an approximately rectangular shape, the length of the horizontal sides of the aperture being greater than that of its vertical sides.

7. Cathode-ray tube according to claim 1, wherein the magnetic screen includes notches on two opposed sides of its rear aperture and the depth $N_v$ of the notches is less than their width $N_h$.

8. Cathode-my tube according to claim 1, wherein the width $N_h$ of the notches is at most equal to 60% of the length $R_h$ of that side of the rear aperture of the magnetic screen on which the respective notches lie.

* * * * *